United States Patent [19]

Shibata et al.

[11] Patent Number: 4,896,163

[45] Date of Patent: Jan. 23, 1990

[54] MICROWAVE RECEIVING DEVICE

[75] Inventors: Toshio Shibata; Kenji Matsumoto, both of Fukaya, Japan

[73] Assignee: Kabushiki Kaisha Toshiba, Kawasaki, Japan

[21] Appl. No.: 215,390

[22] Filed: Jul. 5, 1988

[30] Foreign Application Priority Data

Jul. 6, 1987 [JP] Japan ..... 62-102787[U]
Sep. 30, 1987 [JP] Japan ..... 62-148441[U]

[51] Int. Cl.[4] ..... H01Q 13/02

[52] U.S. Cl. ..... 343/786; 343/756; 333/21 A

[58] Field of Search ..... 343/756, 762, 772, 786, 343/840, 841; 333/208, 211, 226, 21 A; 455/300, 328

[56] References Cited

U.S. PATENT DOCUMENTS

| | | | |
|---|---|---|---|
| 4,547,901 | 10/1985 | Shibata et al. | 455/300 |
| 4,571,593 | 2/1986 | Martinson | 343/786 |
| 4,608,713 | 8/1986 | Shiomi et al. | 455/328 |
| 4,613,989 | 9/1986 | Fende et al. | 343/786 |
| 4,672,388 | 6/1987 | Grim | 343/786 |
| 4,679,249 | 7/1987 | Tanaka et al. | 455/328 |

FOREIGN PATENT DOCUMENTS

| | | | |
|---|---|---|---|
| 0023602 | 2/1984 | Japan | 343/762 |
| 0005702 | 1/1987 | Japan | 333/208 |
| 0018802 | 1/1987 | Japan . | |

*Primary Examiner*—Joseph E. Clawson, Jr.
*Assistant Examiner*—Doris J. Johnson
*Attorney, Agent, or Firm*—Cushman, Darby & Cushman

[57] ABSTRACT

A microwave receiving device of this invention includes a primary radiator and a low-noise converter arranged integrally therewith. One end of a chassis of the microwave receiving device is connected to a flange having an opening shape designed to provide a predetermined directivity characteristics. A waveguide as a primary radiator having a circular cross section is arranged along substantially the entire length of the chassis. A circularly polarized wave generator is arranged in the waveguide to convert a circularly polarized wave propagating through the waveguide into a vertically polarized wave. The vertically polarized wave converted by the circularly polarized wave generator is converted into an electrical signal by a probe. The probe is connected to microwave circuit boards mounted in the chassis. A microwave circuit serving as a low-noise converter is formed on the circuit boards. The electrical signal from the probe is processed by the microwave circuit formed on the circuit boards. The processed signal is externally output from a connector connected to the circuit boards.

19 Claims, 2 Drawing Sheets

MICROWAVE RECEIVING DEVICE

BACKGROUND OF THE INVENTION

1. Field of the Invention

The present invention relates to a microwave receiving device for receiving a microwave such as a satellite broadcast and, more particularly, to a microwave receiving device having functions of a primary radiator and a low-noise converter and suitable for a compact receiving antenna system.

2. Description of the Related Art

A microwave receiving antenna and, particularly, a receiving antenna for satellite broadcast generally comprises a parabolic reflector, a primary radiator, a low-noise converter, an arm, a mount, and a pole. The arm, the mount, and the pole are used to support the reflector, the radiator, and the converter. The parabolic reflector reflects a microwave and focuses it on the primary radiator arranged at a focal point of the reflector. The primary radiator comprises a horn portion for obtaining a desired primary radiation pattern and a circularly polarized wave generator for converting a circularly polarized wave normally used in satellite broadcast into a linearly polarized wave. The low-noise converter converts, e.g, a 12-GHz broadcast signal into a 1-GHz signal and amplifies the 1-GHz signal.

The primary radiator and the low-noise converter are prepared as separate components in a conventional antenna and are coupled through flanges of the radiator and the converter. In a 12-GHz receiving antenna, a primary radiator has an average length of 10 cm, and a low-noise converter has an average length of 15 cm. With the above arrangement, the total length is as large as 20 to 25 cm. In contrast, parabolic reflectors have been made compact because the opening efficiency of such reflectors and the performance of the low-noise converter used in combination with said reflectors have been improved. Therefore, the diameter of a 12-GHz parabolic reflector is generally 40 to 50 cm at present. In the receiving antenna described above, the total length of the primary radiator and the low-noise converter connected thereto is ½ the diameter of the parabolic reflector. For this reason, inertia moments of the primary radiator and the low-noise converter are increased and tend to receive a wind pressure. Therefore, strength of the mounting arm for the primary radiator and the low-noise converter must be increased.

An offset type receiving antenna is very popular because it tends not to be adversely affected by snow. Particularly, in this case, the total length of the primary radiator and the low-noise converter is large as compared with the size of the parabolic reflector, thus causing unbalance in design.

As described above, since the conventional primary radiator and low-noise converter are bulky, achieving the necessary rigid structure of the receiving antenna increases cost. In addition, it is difficult to fit the conventional primary radiator and low-noise converter with a compact parabolic reflector.

SUMMARY OF THE INVENTION

The present invention has been made to solve the conventional problems described above, and has as its object to provide a compact microwave receiving device having functions of a primary radiator and a low-noise converter.

According to the present invention, there is provided a microwave receiving device for receiving a microwave transmitted as a circularly polarized wave, comprising: chassis means having an opening at one end thereof, the opening having a shape for providing predetermined directivity characteristics; waveguide means having a circular cross section and formed inside the chassis means from the opening of the chassis means along substantially the entire length of the chassis means; circularly polarized wave-to-linearly polarized wave converting means, arranged inside the waveguide means, for converting a circularly polarized wave propagating through the waveguide means into a predetermined linearly polarized wave; probe means, extending into the waveguide means through the chassis means, for receiving the predetermined linearly polarized wave, converting the wave into an electrical signal, and outputting the electrical signal outside the chassis means; microwave circuit board means mounted on the chassis means so as to surround at least part of the waveguide means and connected to the probe means, the microwave circuit board means being provided with a microwave circuit for performing predetermined signal processing of the electrical signal output from the probe means; and connector means, connected to the microwave circuit board means, for externally outputting the electrical signal processed by the microwave circuit.

DETAILED DESCRIPTION OF THE PREFERRED EMBODIMENTS

Microwave receiving devices according to embodiments of the present invention will be described with reference to the accompanying drawings.

Figure 1:
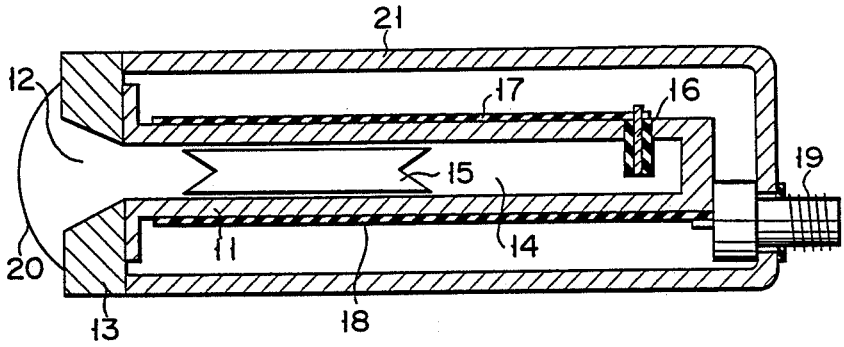
FIG. 1 is a sectional view showing a microwave receiving device according to an embodiment of the present invention.

FIG. 1 is a sectional view showing a microwave receiving device according to an embodiment of the present invention. Chassis 11 is made of an aluminum die cast body having a rectangular cross section. Horn 13, having opening 12, and made of a metal by, e.g., aluminum die casting, is mounted at one end of chassis 11. Opening 12 has a predetermined opening angle so that predetermined directivity characteristics are obtained. In other words, opening 12 has the function of a horn portion of the primary radiator. Waveguide 14 having a circular cross section is formed inside chassis 11 along substantially the overall length of chassis 11. A circularly polarized wave generator (circularly polarized wave-to-linearly polarized wave converter) 15 made of a dielectric plate is inserted at a predetermined angle in waveguide 14.

Electric field coupling type probe 16 is arranged near the other end of waveguide 14 to convert a microwave propagating through waveguide 14 into an electrical signal. Probe 16 is connected to microwave circuit boards 17 and 18. Microwave circuit boards 17 and 18 are arranged in the peripheral portion of chassis 11 so as to surround waveguide 14 and have a microwave circuit thereon. The microwave circuit has a function of a low-noise converter for performing frequency conversion. A received signal which is frequency-converted by microwave circuit on circuit boards 17 and 18, that is, an output from the microwave receiving device, can be extracted from connector 19. Chassis 11 is housed in feedome 20 and case 21 made of a metal by aluminum die casting, thereby having an air-tight or waterproof structure.

With the above arrangement, waveguide 14 is arranged inside chassis 11, and microwave circuit boards 17 and 18, functioning as a low-noise converter, are arranged outside chassis 11. In addition, horn 13 defines opening 12 having the function of a horn portion, thereby providing a compact microwave receiving device.

An arrangement obtained by applying the above embodiment to a microwave receiving antenna for satellite broadcast or the like will be described with reference to FIG. 2.

Figure 2:
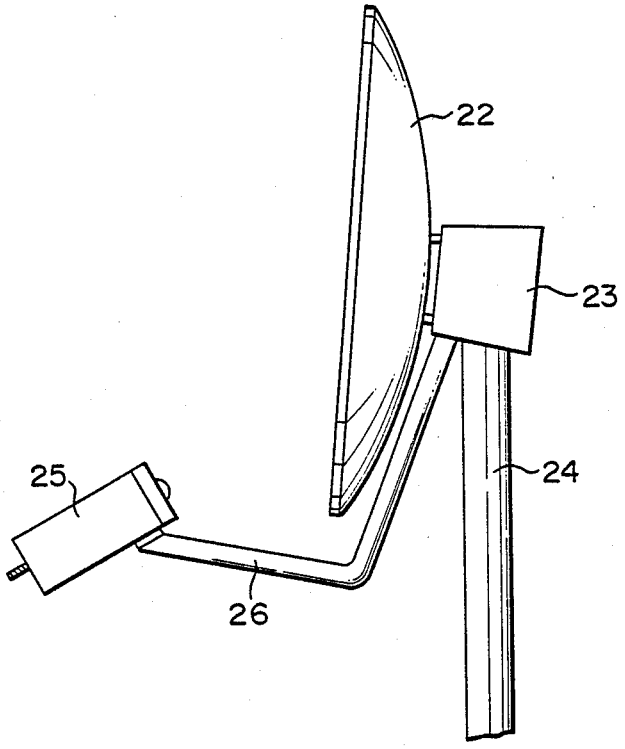
FIG. 2 is a view showing a structure in which the embodiment shown in FIG. 1 is applied to an offset type receiving antenna.

Referring to FIG. 2, parabolic reflector 22 is supported by mount 23 and support pole 24. Microwave receiving device 25 according to the present invention as is shown in FIG. 1 is supported by arm 26. A primary radiator and a low-noise converter are integrally arranged in this microwave receiving device 25. Therefore, the overall length is reduced to about 15 cm, which is about $\frac{1}{3}$ the diameter (40 to 50 cm) of parabolic reflector 22.

The inertia moment of microwave receiving device 25 is small, so that the strength of arm 26 and cost can be reduced. Two aluminum die cast members as the primary radiator and the low-noise converter which have been required in the conventional microwave receiving device can be mounted in common chassis 11, thus further decreasing cost.

Even if microwave receiving device 25 is applied to the offset type receiving antenna shown in FIG. 2, it can still operate well with compact parabolic reflector 22.

An opening angle of opening 12 must be designed in accordance with reflector 22. In this embodiment, since horn 13 is a member separate from chassis 11, horn 13 can be replaced with another one to cope with various reflectors.

In the above embodiment, waveguide 14 having a circular cross section is arranged inside chassis 11 along substantially the overall length of chassis 11. However, the present invention is not limited to the above arrangement. Since a circularly polarized wave guide to waveguide 14 is converted into a linearly polarized wave by circularly polarized wave generator 15, a waveguide portion extending from generator 15 need not have a circular cross section.

Figure 3A:
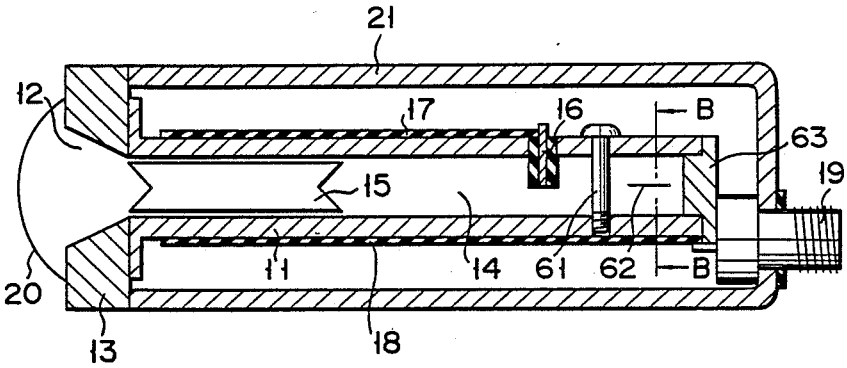
FIG. 3A is a sectional view showing a microwave receiving device according to another embodiment of the present invention.
Figure 3B:
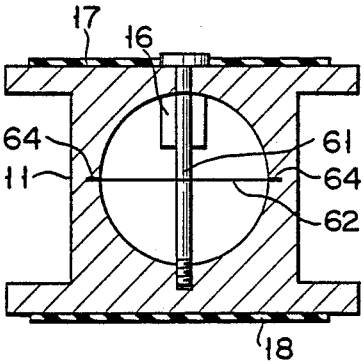
FIG. 3B is a sectional view of a chassis shown in FIG. 3A along the line B—B therein.

Another embodiment of the present invention will be described with reference to FIGS. 3A and 3B. The same reference numerals as in FIG. 1 denote the same parts in FIGS. 3A and 3B, and a detailed description thereof will be omitted.

A microwave receiving device in this embodiment includes short rod 61, resistor 62, and short plate 63. Short rod 61 allows transmission of a horizontally polarized wave therethrough and reflects a vertically polarized wave. (Note that "horizontally polarized wave" means a linearly polarized wave which is perpendicular to probe 16, whereas "vertically polarized wave" means a linearly polarized wave which is parallel to probe 16.) A circularly polarized wave is converted into a vertically polarized wave by circularly polarized wave generator 15. In this case, a small horizontally polarized wave is also generated. Probe 16 normally receives the vertically polarized wave, and the horizontally polarized wave is an interfering component. Therefore, only the vertically polarized wave is reflected toward probe 16 by short rod 61.

Resistor 62 absorbs the horizontally polarized wave as the interfering component. Since the resistor is generally arranged to prevent degradation of reception performance and to effectively absorb the interfering component, the resistor must be accurately positioned to be perpendicular to probe 16 and aligned on the axis of waveguide 14. Therefore, slits may be formed in waveguide 14 to perform accurate positioning.

In the embodiment shown in FIG. 1, however, the position of the resistor may be an intermediate position between circularly polarized wave generator 15 and probe 16. However, since this position is separated from opening 12 of waveguide 14, slit formation is difficult. Therefore, mounting of the resistor is inefficient.

In the second embodiment, short rod 61, which extends parallel to probe 16, is located behind probe 16, or positioned closer to the rear of inside chassis 11 than probe 16. This rod 61 causes a short-circuiting of waveguide 14, with respect to the linearly polarized wave vertically generated by circularly polarized wave generator 15. Resistor 62 is mounted behind short rod 61 in a direction perpendicular to the vertically polarized wave to absorb the interfering component of the horizontally polarized wave perpendicular to the vertically polarized wave. Waveguide 14 is closed by short plate 63 to prevent leakage of the microwave which is not reflected by short rod 61 nor absorbed by resistor 62. FIG. 3B is a sectional view of the microwave receiving device shown in FIG. 3A along the line B—B therein.

According to this embodiment, formation of slits 64 for positioning resistor 62 and mounting of resistor 62 can be performed from the short plate side prior to mounting of short plate 63. Therefore, workability can be greatly improved.

The mounting position of short rod 61 must be appropriately determined so as to obtain desired characteristics because the characteristics of the microwave receiving device are determined by the length of probe 16 and the distance between probe 16 and short rod 61.

According to the microwave receiving device of the present invention as described above, a compact arrangement can be achieved with a primary radiator function and a low-noise converter function. Therefore, the requirement for mechanical strength of the receiving antenna structure can be decreased, and an excellent appearance in design can be achieved.

It is also possible to form horn 13 and chassis 11 as one body, which as a further advantage in that the manufacturing cost will be reduced.

What is claimed is:

1. A microwave receiving device for receiving a microwave transmitted as a circularly polarized wave, comprising:

chassis means having an opening at one end thereof, the opening having a shape for providing predetermined directivity characteristics;

waveguide means having a circular cross section and formed inside said chassis means from said opening of said chassis means along substantially the entire length of said chassis means;

circularly polarized wave-to-linearly polarized wave converting means, arranged inside said waveguide means, for converting a circularly polarized wave propagating through said waveguide means into a predetermined linearly polarized wave;

probe means, extending into said waveguide means through said chassis means, for receiving the predetermined linearly polarized wave, converting the wave into an electrical signal, and outputting the electrical signal outside said chassis means;

microwave circuit board means mounted on said chassis means so as to surround at least part of said waveguide means and connected to said probe means, said microwave circuit board means being provided with a microwave circuit for performing predetermined signal processing of the electrical signal output from said probe means; and connector means, connected to said microwave circuit board means, for externally outputting the electrical signal processed by said microwave circuit.

2. The device according to claim 1, wherein said waveguide means has a circular cross section from a portion at a position corresponding to said opening of said chassis means to a portion at a position corresponding to said circularly polarized wave-to-linearly polarized wave converting means.

3. The device according to claim 2, wherein said waveguide means has a circular cross section along substantially the entire length of said chassis means.

4. The device according to claim 1, wherein said chassis means comprises a chassis incorporating said waveguide means therein and a horn mounted at said one end of said chassis and having a shape for providing the predetermined directivity characteristics.

5. The device according to claim 4, wherein said chassis has a rectangular cross section, and said microwave circuit board means is mounted on at least one side of said rectangular chassis.

6. The device according to claim 4, further comprising case means, mounted on said flange, for waterproofing said chassis by incorporating said chassis therein.

7. The device according to claim 1, wherein said circularly polarized wave-to-linearly polarized wave converting means includes a circularly polarized wave generator inserted at a predetermined angle in said waveguide means and made of a dielectric plate.

8. The device according to claim 1, wherein the predetermined linearly polarized wave is a vertically polarized wave.

9. The device according to claim 1, further comprising:

a short rod mounted in said waveguide means and spaced apart from said probe by a predetermined distance toward the other end of said chassis means, said short rod being arranged to reflect the predetermined linearly polarized wave and transmit a linear polarized wave in a direction perpendicular to the predetermined linearly polarized wave; and a resistor arranged inside said waveguide means spaced apart from said short rod by a predetermined distance toward the other end of said chassis means, said resistor being arranged to absorb the linearly polarized wave in the direction perpendicular to the predetermined linearly polarized wave.

10. The device according to claim 9, wherein the predetermined distance between said probe means and said short rod is determined based upon the length of said probe means.

11. The device according to claim 10, further comprising a short plate for closing the other end of said chassis means.

12. The device according to claim 10, wherein said waveguide means has a circular cross section from a portion at a position corresponding to said opening of said chassis means to a portion at a position corresponding to said circularly polarized wave-to-linearly polarized wave converting means.

13. The device according to claim 12, wherein said waveguide means has a circular cross section along a substantially overall length of said chassis means.

14. The device according to claim 11, wherein said chassis means comprises a chassis incorporating said waveguide means therein and a horn mounted at said one end of said chassis and having a shape for providing the predetermine directivity characteristics.

15. The device according to claim 14, wherein said chassis has a rectangular cross section, and said microwave circuit board means is mounted on at least one side of said rectangular chassis.

16. The device according to claim 14, further comprising case means, mounted on said flange, for waterproofing said chassis by incorporating said chassis therein.

17. The device according to claim 10, wherein said circularly polarized wave-to-linearly polarized wave converting means includes a circularly polarized wave generator inserted at a predetermined angle in said waveguide means and made of a dielectric plate.

18. The device according to claim 10, wherein the predetermined linearly polarized wave is a vertically polarized wave.

19. A satellite broadcast receiving antenna apparatus for receiving a satellite broadcast wave transmitted as a circularly polarized wave, comprising:

parabolic reflector means directed toward a broadcast satellite; and a microwave receiving device located at a focal point of said parabolic reflector means, including:

chassis means having an opening at one end thereof, the opening having a shape for providing predetermined directivity characteristics;

waveguide means having a circular cross section and formed inside said chassis means from said opening of said chassis means along substantially the entire length of said chassis means;

circularly polarized wave-to-linearly polarized wave converting means, arranged inside said waveguide means, for converting a circularly polarized wave propagating through said waveguide means into a predetermined linearly polarized wave;

probe means, extending into said waveguide means through said chassis means, for receiving the predetermined linearly polarized wave, converting the wave into an electrical signal, and outputting the electrical signal outside said chassis means;

microwave circuit board means mounted on said chassis means so as to surround at least part of said waveguide means and connected to said probe means, said microwave circuit board means being provided with a microwave circuit for performing predetermined signal processing of the electrical signal output from said probe means; and connector means, connected to said microwave circuit board means, for externally outputting the electrical signal processed by said microwave circuit.

* * * * *